US008705788B2

(12) United States Patent
Xu et al.

(10) Patent No.: US 8,705,788 B2
(45) Date of Patent: Apr. 22, 2014

(54) SPEAKER AND METHOD FOR FABRICATING SAME

(75) Inventors: Chao Xu, Shenzhen (CN); Xing-Zhi Huang, Shenzhen (CN); Rong-Lin Ling-Hu, Shenzhen (CN); Xiong Zhang, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 251 days.

(21) Appl. No.: 12/978,570

(22) Filed: Dec. 26, 2010

(65) Prior Publication Data

US 2012/0163644 A1 Jun. 28, 2012

(51) Int. Cl.
*H04R 1/00* (2006.01)

(52) U.S. Cl.
USPC ..... 381/410; 381/331; 381/396; 381/401; 381/409; 381/433

(58) Field of Classification Search
USPC ..... 381/331, 406, 396, 401, 409–410, 433
See application file for complete search history.

(56) References Cited

U.S. PATENT DOCUMENTS

| | | | | |
|---|---|---|---|---|
| 4,697,283 | A * | 9/1987 | Lafrance et al. | 379/443 |
| 7,418,106 | B2 * | 8/2008 | Greuet et al. | 381/331 |
| 7,791,551 | B2 * | 9/2010 | Platz | 343/718 |
| 7,974,426 | B2 * | 7/2011 | Park | 381/312 |
| 2010/0237976 | A1 * | 9/2010 | Li et al. | 336/200 |

FOREIGN PATENT DOCUMENTS

| | | | | |
|---|---|---|---|---|
| WO | WO 2008/003583 | * | 1/2008 | H04R 3/12 |

* cited by examiner

*Primary Examiner* — Curtis Kuntz
*Assistant Examiner* — Ryan Robinson
(74) *Attorney, Agent, or Firm* — IPro, Inc.; Na Xu

(57) ABSTRACT

A method for fabricating a speaker is disclosed. The speaker is equipped with a case having a through cavity, an inner surface forming the cavity and an outer surface, a magnetic bowl coupled to the case, a magnet positioned in the magnetic bowl, a pole plate covering the magnet, a magnetic gap formed by the magnet and the magnetic bowl, a diaphragm supported by the case and vibrating along a vibrating direction, a voice coil connected to the diaphragm, and a hearing aid coil formed on the case. The method includes the steps of: providing a case made of thermoplastic doped with organometallic additive; activating the organometallic additive in the case by a laser beam for forming initial pattern of the hearing aid coil in the inner surface of the case; and bathing the case in copper solution for providing the initial pattern with copper plating layer.

2 Claims, 3 Drawing Sheets

SPEAKER AND METHOD FOR FABRICATING SAME

BACKGROUND OF THE INVENTION

1. Field of the Invention

The present invention generally relates to the arts of speakers and more particularly to a method for fabricating a speaker having a hearing aid coil (HAC).

2. Description of Related Art

In recent years, with the proliferation of slim-type electronic devices such as liquid crystal display devices or mobile telephones, there is a demand for thin-type and slim-type speakers with high performance. Generally, a speaker includes a case, a magnetic bowl coupled to the case, a magnet positioned in the magnetic bowl, a pole plate covering the magnet, a magnetic gap formed by the magnet and the magnetic bowl, a diaphragm supported by the case and vibrating along a vibrating direction, a voice coil connected to the diaphragm, and a hearing aid coil wound between the magnetic bowl and the case. The hearing aid coil is used for providing enhanced sound to users with hearing disorder. A speaker with such structure will occupy more inner space and increase the volume of the speaker, because the speaker needs to provide some space to accommodate the hearing aid coil.

So, it is necessary to provide a new method for fabricating a speaker to solve the problem mentioned above.

DETAILED DESCRIPTION OF THE EMBODIMENTS

Reference will now be made to describe the exemplary embodiments of the present invention in detail.

Figure 1:
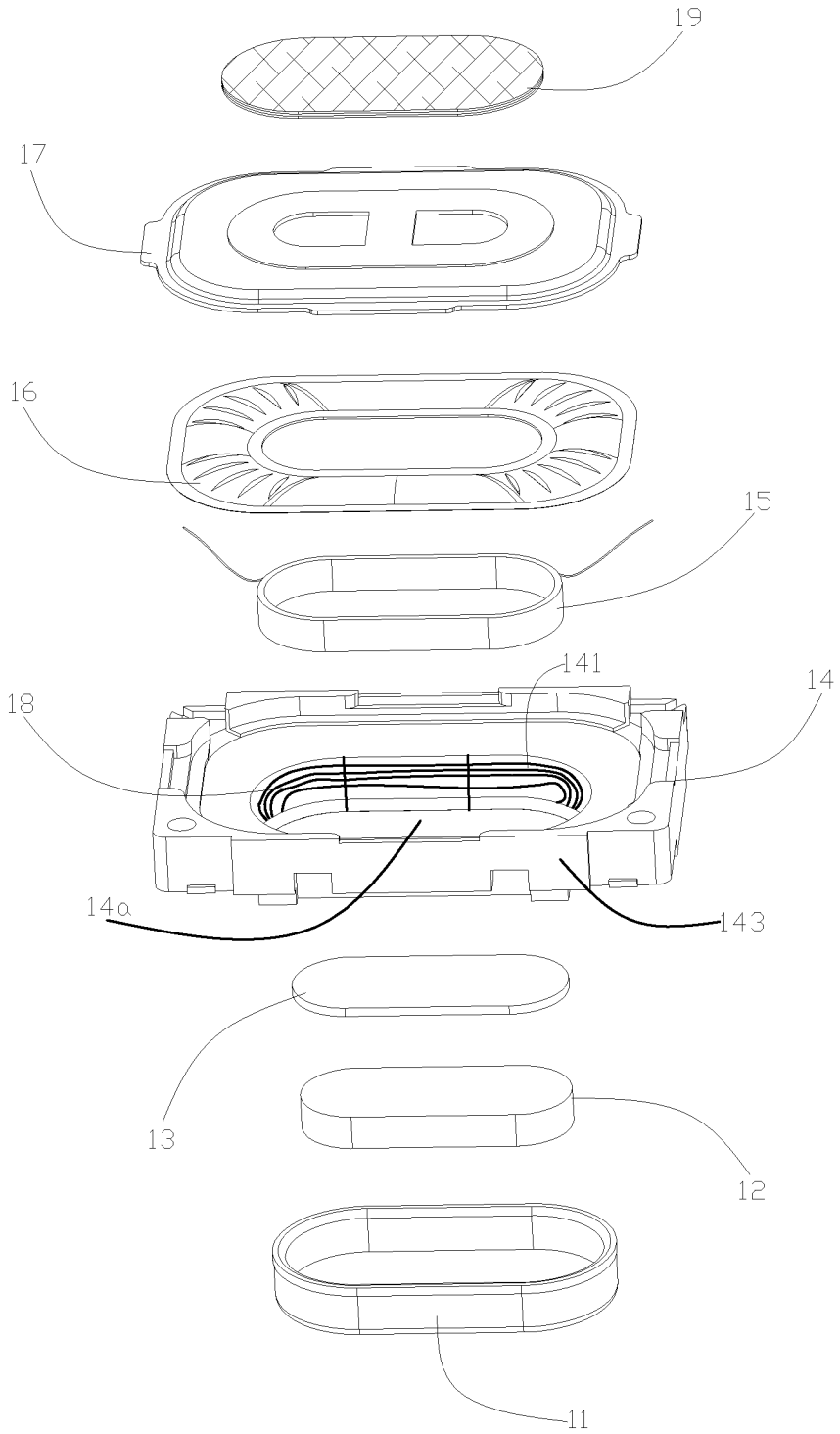
FIG. 1 is an exploded view of a speaker in accordance with a first embodiment of the present invention.

Referring to FIG. 1, a speaker 1 of a first embodiment of the present invention comprises a case 14, a magnetic bowl 11 coupled to the case 14, a magnet 12 positioned in the magnetic bowl 11, a pole plate 13 covering the magnet 12, a magnetic gap formed by the magnet 12 and the magnetic bowl 11, a diaphragm 16 supported by the case 14 and vibrating along a vibrating direction, a voice coil 15 connected to the diaphragm 14, a cover 17 coupled to the case 14, a dustproof device 19 connected t the cover 17, and a hearing aid coil 18 formed on the case 14.

The case 14 has a through cavity 14*a*, an inner surface 141 forming the cavity 14*a*, and an outer surface 143. The hearing aid coil 18 is a copper plating layer on the inner surface 141 of the case. While assembled, the inner surface 141 surrounds the magnetic bowl 11. A method for fabricating the speaker 1 mentioned above comprises the steps of:

providing a case 14 made of thermoplastic doped with organometallic additive;

activating the organometallic additive in the case 14 by a laser beam for forming initial pattern of the hearing aid coil 18 in the inner surface 141 of the case;

bathing the case 14 in copper solution for providing the initial pattern with copper plating layer.

Finally, the pattern with copper plating layer serves as the hearing aid coil. And the hearing aid coil is formed on the inner surface 141 of the case 14.

Figure 2:
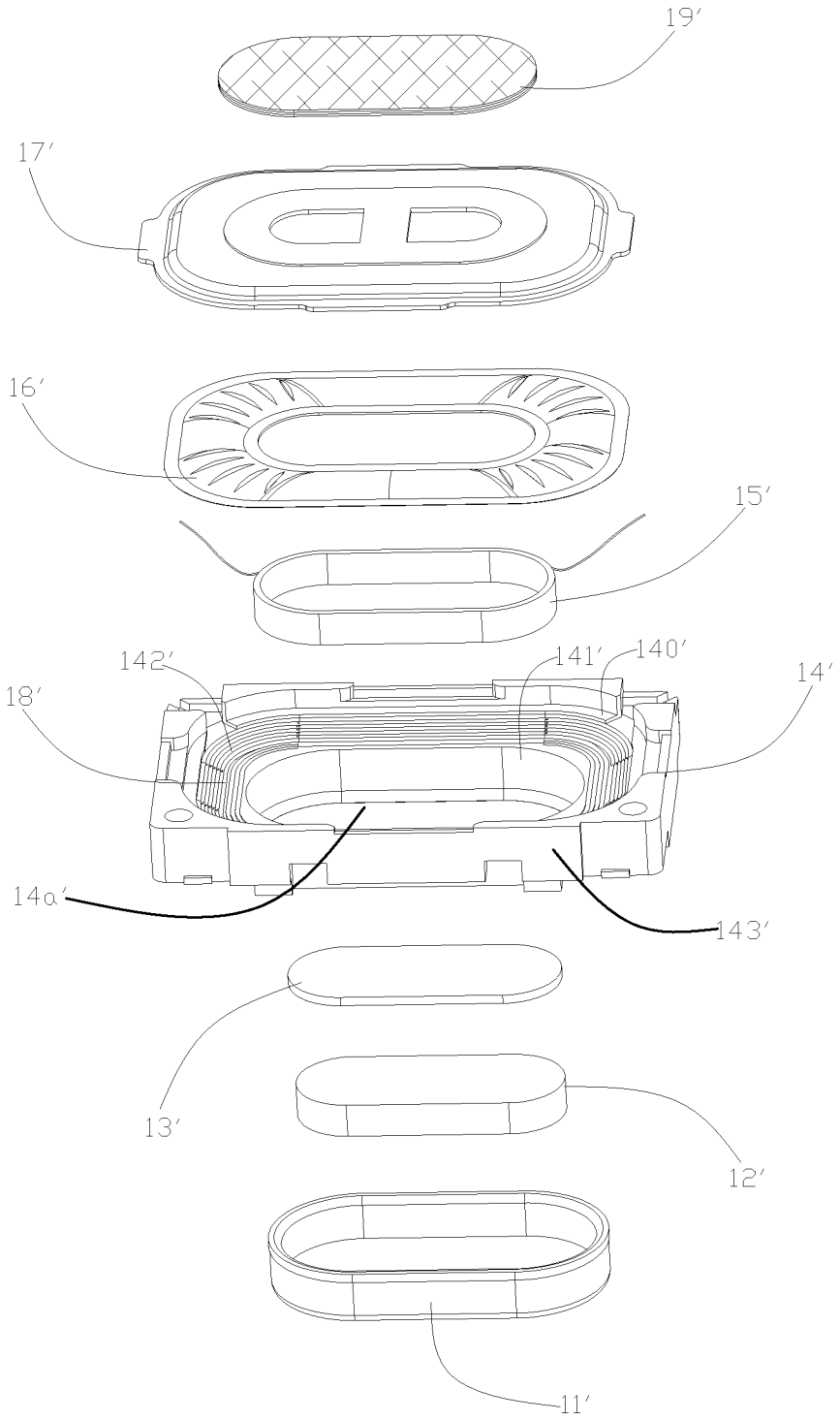
FIG. 2 is an exploded view of a speaker in accordance with a second embodiment of the present invention.
Figure 3:
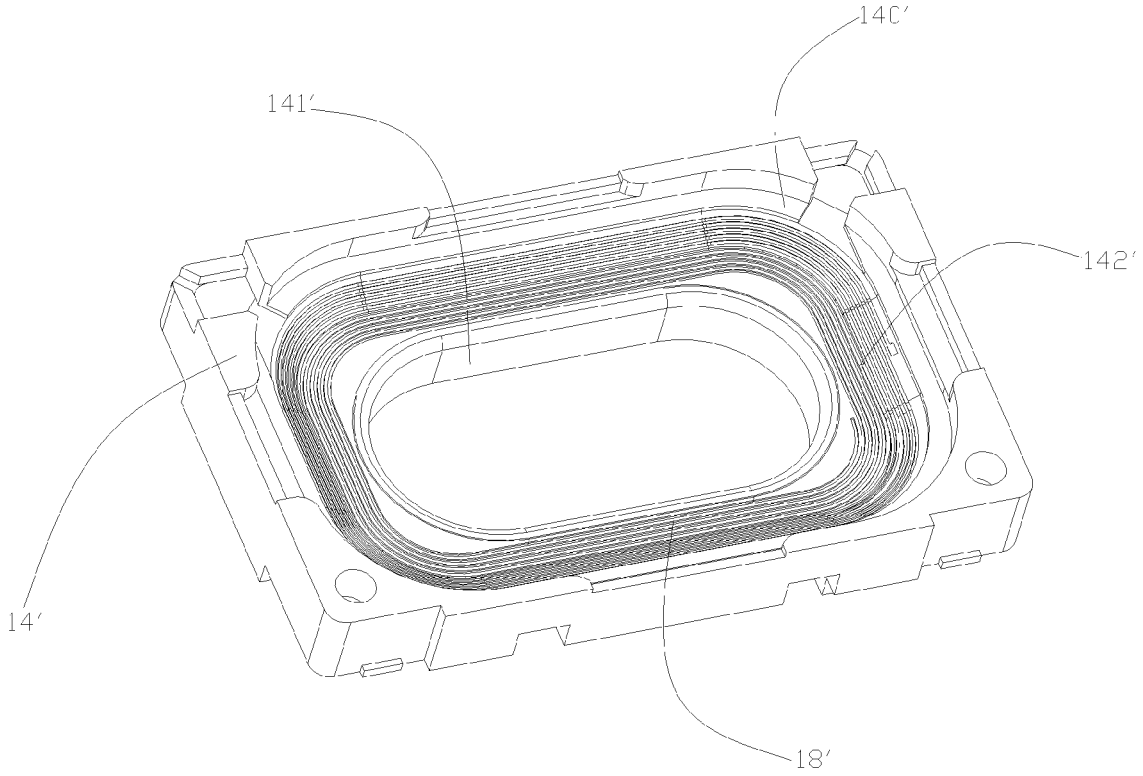
FIG. 3 is an isometric and enlarged view of a case used in the speaker in FIG. 2.

Referring to FIG. 2 and FIG. 3, a speaker 1' of a second embodiment of the present invention comprises a case 14', a magnetic bowl 11' coupled to the case 14', a magnet 12' positioned in the magnetic bowl 11', a pole plate 13' covering the magnet 12', a magnetic gap formed by the magnet 12' and the magnetic bowl 11', a diaphragm 16' supported by the case 11' and vibrating along a vibrating direction, a voice coil 15' connected to the diaphragm 16', a cover 17' coupled to the case 14', a dustproof device 19' connected t the cover 17', and a hearing aid coil 18' formed on the case 14'.

The case 14' has a through cavity 14*a*', an inner surface 141' forming the cavity 14*a*', an outer surface 143', an upper surface 140' extending perpendicularly to the inner surface 141', and a slope 142' extending from the upper surface 140' to the inner surface 141'. The hearing aid coil 18' is a copper plating layer on the slope 142' of the case 14'. While assembled, the inner surface 141' surrounds the magnetic bowl 11'.

A method for fabricating the speaker 1' mentioned above comprises the steps of:

providing a case 14' made of thermoplastic doped with organometallic additive;

activating the organometallic additive in the case 14' by a laser beam for forming initial pattern of the hearing aid coil 18' in the slope 142' of the case 14';

bathing the case 14' in copper solution for providing the initial pattern with copper plating layer.

Finally, the pattern with copper plating layer serves as the hearing aid coil. And the hearing aid coil is formed on the slope 142' of the case 14'.

As the hearing aid coil is in fact a plating layer, the speaker do not need to provide extra space for accommodating the hearing aid coil. Therefore, volume of the speaker is reduced.

While the present invention has been described with reference to specific embodiments, the description of the invention is illustrative and is not to be construed as limiting the invention. Various of modifications to the present invention can be made to the exemplary embodiments by those skilled in the art without departing from the true spirit and scope of the invention as defined by the appended claims.

What is claimed is:

1. A speaker comprising:

a case having a through cavity, an inner surface forming the cavity, an outer surface, an upper surface perpendicular to the inner surface and a slope extending from the upper surface to the inner surface;

a magnetic bowl coupled to the case;

a magnet positioned in the magnetic bowl;

a pole plate covering the magnet;

a magnetic gap formed by the magnet and the magnetic bowl;

a diaphragm supported by the case and vibrating along a vibrating direction;

a voice coil connected to the diaphragm; and a hearing aid coil formed on the inner surface; wherein the hearing aid coil is a copper plating layer on the slope of the case and the inner surface surrounds the magnetic bowl, the hearing aid coil forms a ring surrounding the magnetic bowl.

2. A method for fabricating a speaker comprising the steps of:

providing a case made of thermoplastic doped with organometallic additive and having a through cavity, an inner surface forming the cavity, an outer surface, an upper surface perpendicular to the inner surface and a slope extending from the upper surface to the inner surface;

providing a magnetic bowl coupled to the case;

providing a magnet system having a magnetic gap;

providing a diaphragm supported by the case and vibrating along a vibrating direction;

providing a voice coil driving the diaphragm;

activating the organometallic additive in the case by a laser beam for forming initial pattern of a hearing aid coil in the slope of the case, the initial pattern of a hearing aid coil forms a ring surrounding the magnetic bowl; and bathing the case in copper solution for providing the initial pattern with copper plating layer.

* * * * *